United States Patent [19]

Rudick et al.

[11] Patent Number: 4,892,125

[45] Date of Patent: Jan. 9, 1990

[54] SYSTEM FOR SERVING A PRE-MIX BEVERAGE OR MAKING AND SERVING A POST-MIX BEVERAGE IN THE ZERO GRAVITY CONDITIONS OF OUTER SPACE

[75] Inventors: Arthur G. Rudick, Marietta; Richard H. Heenan, Atlanta; William S. Credle, Jr., Stone Mountain, all of Ga.

[73] Assignee: The Coca-Cola Company, Atlanta, Ga.

[21] Appl. No.: 211,271

[22] Filed: Jun. 23, 1988

Related U.S. Application Data

[62] Division of Ser. No. 769,464, Aug. 26, 1985, Pat. No. 4,785,974.

[51] Int. Cl.[4] ..... B65B 1/04

[52] U.S. Cl. ..... 141/353; 222/190; 99/323.1; 251/149.7

[58] Field of Search ..... 222/105, 3, 6, 190; 141/346, 347, 353, 354; 99/323.1, 323.2; 137/613, 614; 251/149.6, 149.7

[56] References Cited

U.S. PATENT DOCUMENTS

| | | | |
|---|---|---|---|
| 1,465,254 | 8/1923 | Davis | 141/353 |
| 3,492,671 | 11/1970 | Hovey | 99/323.1 |
| 4,497,348 | 2/1985 | Sedam | 99/323.1 |
| 4,636,337 | 1/1987 | Gupta et al. | 99/323.1 |

FOREIGN PATENT DOCUMENTS

| | | | |
|---|---|---|---|
| 1389305 | 11/1965 | France | 141/353 |

*Primary Examiner*—Joseph J. Rolla
*Assistant Examiner*—Kenneth Noland
*Attorney, Agent, or Firm*—Birch, Stewart, Kolasch & Birch

[57] ABSTRACT

A system for serving a pre-mix beverage and making and serving a post-mix carbonated beverage in outer space including a special drinking cup structure and individual serving flavor concentrate modules. The drinking cup includes a disposable bag liner within a rigid outer container and a disposable drinking tube attached thereto. The flavor concentrate module is either a serving of concentrate within the bag or a separate module in-line between a source of carbonated water and the drinking cup.

5 Claims, 2 Drawing Sheets

SYSTEM FOR SERVING A PRE-MIX BEVERAGE OR MAKING AND SERVING A POST-MIX BEVERAGE IN THE ZERO GRAVITY CONDITIONS OF OUTER SPACE

This application is a divisional of copending application Ser. No. 769,464, filed on Aug. 26, 1985, now U.S. Pat. No. 4,785,974.

BACKGROUND OF THE INVENTION

The present invention relates to a system for serving a pre-mix beverage or making and serving a post-mix carbonated beverage in the zero gravity conditions of outer space including a special drinking cup structure.

It is known that under zero or micro-gravity conditions of outer space, that beverages cannot be forced from a vessel directly into a consumer's mouth. They must be forced out of the vessels under positive pressure or sucked out through a straw directly into the mouth of the astronaut.

Furthermore, the container utilized for dispensing a food or beverage must be of a collapsible volume type in order to preclude . the creation of an air space or pocket within the container, the location of which cannot be controlled due to the substantially zero gravity conditions.

Examples of food dispensing containers for use in outer space are illustrated in U.S. Pat. Nos. 3,227,308 and 3,373,760, both to Frankenberg.

While the food dispensing containers of Frankenberg are suitable for dispensing food and some liquids in outer space, they would not be suitable for dispensing a carbonated beverage in outer space under the micro-gravity conditions that exist.

SUMMARY OF THE INVENTION

Accordingly, it is a primary object of the present invention to provide a system for serving a pre-mix carbonated beverage or making and serving a post-mix carbonated beverage in outer space including a special drinking cup from which the beverage may be served.

It is a further object of the present invention to provide a system for making a post-mix carbonated beverage in outer space from a single pre-measured serving of flavor concentrate which when mixed with carbonated water forms the post-mix carbonated beverage.

It is another object of the present invention to provide a system for making post-mix carbonated beverages in outer space from a common supply of carbonated water to be mixed with individual servings of flavored concentrate for forming individual beverage servings.

These and other objects of the present invention are fulfilled by providing a drinking cup for carbonated beverages suitable for use in the zero gravity conditions of outer space comprising a rigid container having a removable lid, said removable lid having a central opening therein; a plug removably disposed in the central opening of the removable lid; a collapsible bag containing the carbonated beverage having an open end secured to the plug, the plug supporting the bag within the rigid container; a drinking tube extending from the outside of the plug; a dip tube within the bag extending through the plug and connected to the drinking tube; and a valve on the drinking tube for starting or stopping the flow of carbonated beverage therethrough.

The collapsible bag may contain a pre-measured quantity of flavor concentrate which when mixed with carbonated water fills up the bag and forms an individual serving of carbonated beverage.

In a preferred embodiment of a pre-mix dispensing system, the pre-mix supplied to the bag is provided from a Figal (five gallon) container also provided with a collapsible bag therein. The collapsible bag within the Figal container is surrounded with a counter-pressure gas such as $CO_2$ at approximately 60 p.s.i. in order to maintain the $CO_2$ gas within the pre-mix in solution. The pre-mix is dispensed out through a flow rate control valve into the dip tube of the drinking cup to fill the collapsible bag within the drinking cup.

In a preferred embodiment of a post-mix dispensing system, the carbonated water supplied to the bag is provided from a Figal (five gallon) container also provided with a collapsible bag therein. The collapsible bag within the Figal container is surrounded with a counter-pressure gas such as $CO_2$ at approximately 60 p.s.i. in order to maintain the $CO_2$ gas within the carbonated water in solution. The carbonated water is dispensed out through a flow rate control valve into the dip tube of the drinking cup to fill the collapsible bag within the drinking cup with a sufficient amount of carbonated water to form the post-mix carbonated beverage.

As an alternative to providing a pre-measured quantity of flavor concentrate in a bag within a drinking cup, the pre-measured quantity of flavor concentrate may be provided in a module which is connected in-line between a carbonated water source, such as the Figal described above, and a drinking cup or other form of container for storing and serving a carbonated beverage. In a preferred embodiment, this module includes inlet and outlet ports which are normally closed by spring-biased poppets. The inlet and outlet ports during storage are sealed with safety caps and when hooked up in-line between the carbonated water source and the beverage container are forced open to permit carbonated water to flow through the module where it is mixed with the pre-measured quantity of flavor concentrate to form the post-mix carbonated beverage. The post-mix carbonated beverage then passes into the associated drinking container from which it is to be served.

BRIEF DESCRIPTION OF THE DRAWINGS

The objects of the present invention and the attendant advantages thereof will become more readily apparent with reference to the drawings, like reference numerals referring to like parts, wherein.

DETAILED DESCRIPTION OF PREFERRED EMBODIMENTS

Figure 1:
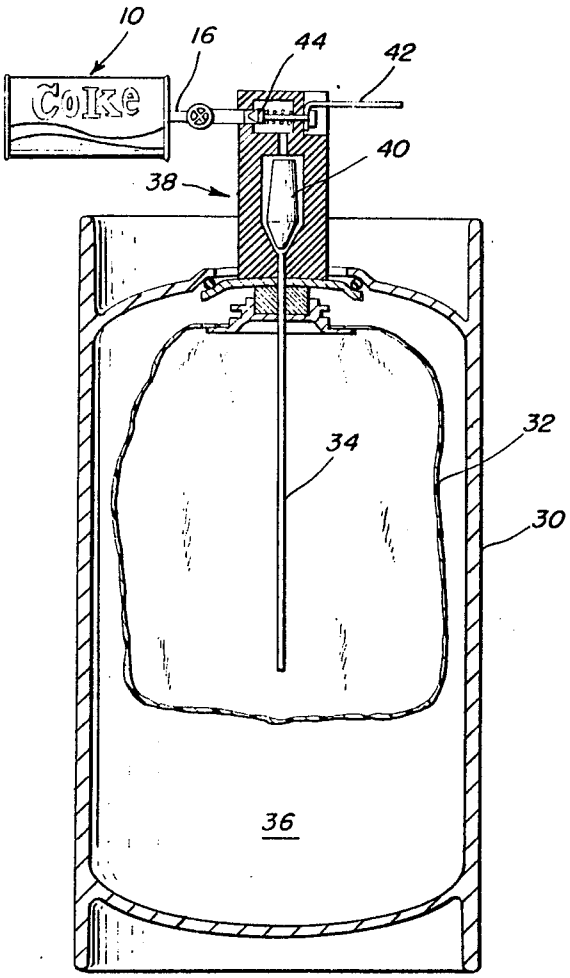
FIG. 1 is a cross-sectional view in side elevation of a source of pre-mix or carbonated water to be used for making the post-mix beverages in the system of the present invention.

Referring in detail to the drawings and more particularly to FIG. 1, there is illustrated a Figal container 30 of a conventional type having a collapsible bag 32 disposed therein for containing beverage pre-mix or carbonated water. Surrounding the bag 32 within the container 30 is counter-pressure $CO_2$ gas at an initial pressure of approximately 60 p.s.i. in order to place a positive pressure on a bag 32 and the beverage pre-mix or carbonated water therein. This counter pressure of the gas 36 keeps the $CO_2$ gas of the carbonated liquid within bag 32 in solution during storage of the container 30. Also provided is a dip tube 34 through which the carbonated liquid flows to a valve assembly 38 including a flow-rate control, bullet-shaped, plunger 40. Also provided in the valve assembly 38 is a spring-loaded poppet 44, which may be opened by a manually actuable lever 42 to withdraw premix or carbonated water from the bag 32 through the dip tube 34 and valve assembly 38. Coupled to valve assembly 38 in an outlet port in which poppet 44 is seated is a drinking cup 10 having a tube 16 extending thereform.

Figure 2:
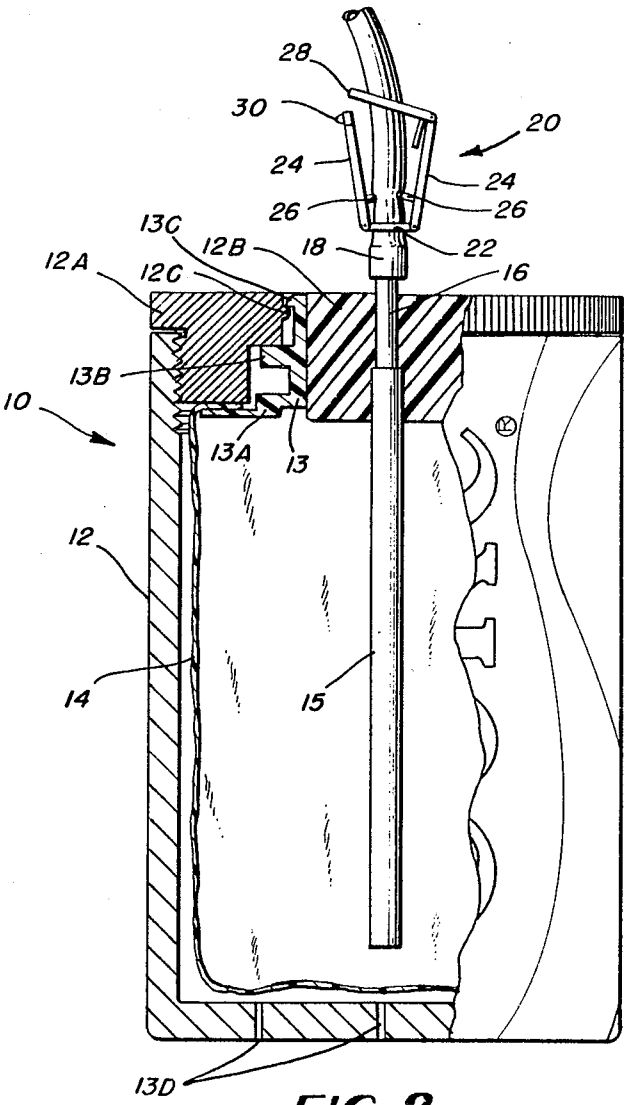
FIG. 2 is a cross-sectional view in side elevation illustrating the structure of a special drinking cup for use in the pre-mix or post-mix beverage systems of the present invention.

Drinking cup 10 is illustrated in more detail in FIG. 2 and includes a rigid outer container 12 having a removable lid 12A which may be screwed onto the top of container 12 by suitable threads as illustrated. The removable lid 12A has a central opening in which a plug 12B is snap-fit by means of an adapter 13. Adapter 13 has a bottom flange 13A which seats on the bottom inner wall of lid 12A and a flange 13B which seats in a recess in lid 12A just below a spring detent protrusion 12C. A boss 13C snap-connects with detent protrusion 12C. Accordingly, the plug 12B is snap-fit in the opening with the lid 12A and can be readily removed, when bag 14 becomes empty, to throw away the bag and associated plug. A new bag and plug assembly would then be snap-fit into the opening in lid 12A and the outer rigid container reused as a drinking cup.

The drinking cup illustrated in FIG. 2 is also provided with a dip tube 15 extending down into the bag 14 for preventing the bag from being sucked into the hole in the plug. The dip tube 15 is coupled to a tube 16 extending through a central aperture in plug 12B. In a drinking mode of operation the tube 16 has its exterior end coupled to a flexible drinking tube or straw 18. The drinking tube 18 may have a pinch valve 20 thereon to start or stop the flow of carbonated beverage into the mouth of the astronaut.

When the pre-mix or post-mix is inside the bag 14 inside the drinking cup it is at atmospheric pressure, because the interior of the cup is vented to atmosphere through the tiny vent holes 13D in the bottom. Therefore, the beverage must be consumed quickly before the $CO_2$ starts to diffuse out of solution.

The pinch valve 20 illustrated in FIG. 2 includes a base 22 surrounding the tube 18 and a pair of pivotable upstanding arms 24 having projections 26 on the inner walls thereof for engaging and pinching the tube 18. One of the upstanding arms has a lateral member 28 extending therefrom for engaging a latch member 31 on the end of the opposite upstanding arm when it is desired to pinch off the flow of carbonated beverage through the tube 18. In the position illustrated in FIG. 2 the pinch valve 20 is open.

In the filling mode of operation of the drinking cup of FIG. 2, the tube 18 is connected to the port within the valve assembly 38 of FIG. 1 adjacent to the poppet 44. It can be seen from the illustration of FIG. 1 that the filling of the drinking cup 10 with pre-mix or with carbonated water is achieved by depressing valve actuation lever 42, which opens poppet 44, and permits carbonated liquid to flow from bag 32 through dip tube 34; valve assembly 38; tube 18; and into container 10. Before filling, no air should be trapped inside of bag 14.

The drinking cup should not be completely filled because that would cause pressure to build up inside the cup which could cause an excessive initial flow rate when the astronaut drinks from the cup. There are two ways to prevent overfilling:

1. Use a clear cup so that the user can visually determine when the cup is almost full in order to manually stop filling; or
2. Install a portion control device on the figal.

When used as a post-mix system in a preferred embodiment of the present invention the bag 14 within the drinking cup 10 is filled with a pre-measured quantity of flavor concentrate which is sufficient to make a desired carbonated beverage within collapsible bag 14 when a bag 14 is filled with carbonated water introduced from the Figal container 30 of FIG. 1. Accordingly, when being used in outer space a plurality of disposable bag assemblies may be utilized to make different varieties of post-mixed carbonated beverages by simply choosing the bag assembly containing the preferred flavor concentrate, inserting it into the rigid outer container, then connecting it to the Figal 30 in the manner illustrated in FIG. 1. When used as a pre-mix system, there is no flavor concentrate in the bag before filling, In an alternative embodiment of the present invention when used as a post-mix system, a pre-measured quantity of flavor concentrate is provided in a module disposed in-line between the Figal tank 30 of FIG. 1 including a source of carbonated water and a beverage serving container such as the container 10 illustrated in FIG. 2, or a container of the type disclosed for dispensing pre-mixed carbonated beverages in U.S. patent application Ser. No. 724,155 filed Apr. 17, 1985, assigned to the same assignee as the present invention. In the case of a low pressure system as shown in FIG. 1 being used to fill the space can of that application, the following modifications are necessary;

1. Remove plug 13—this vents the interior of the can to atmosphere
2. Remove "bullet"—5 and spring 8 -: As the contents of the can are not pressurized, a flow control device is no longer necessary. The user sucks the beverage out of the can.

Figure 3B:
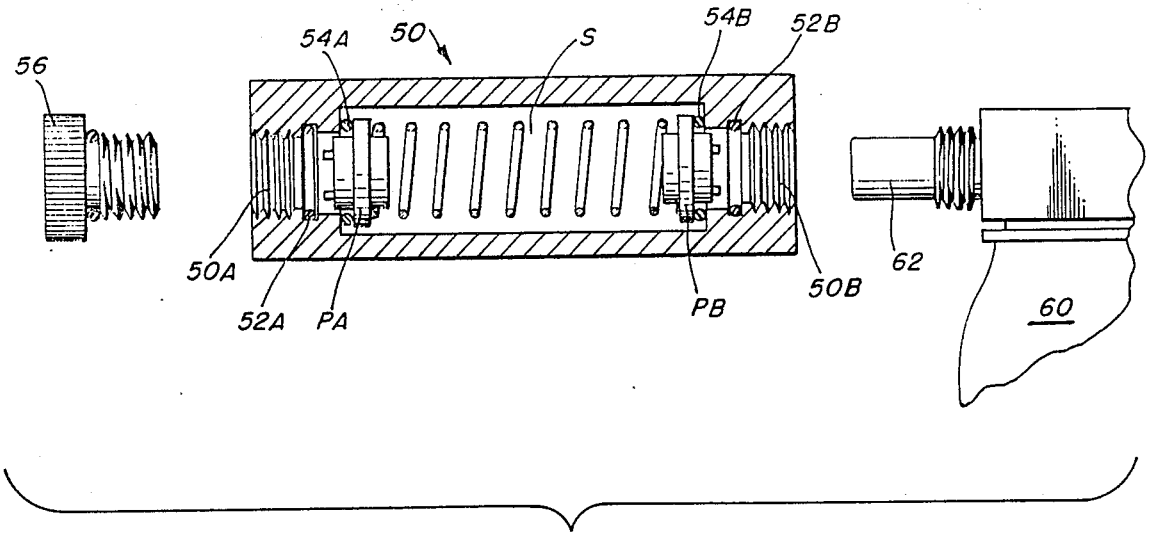
FIG. 3B is a cross-sectional view of a syrup module utilizing the post-mix beverage system of FIG. 3A.
Figure 3A:
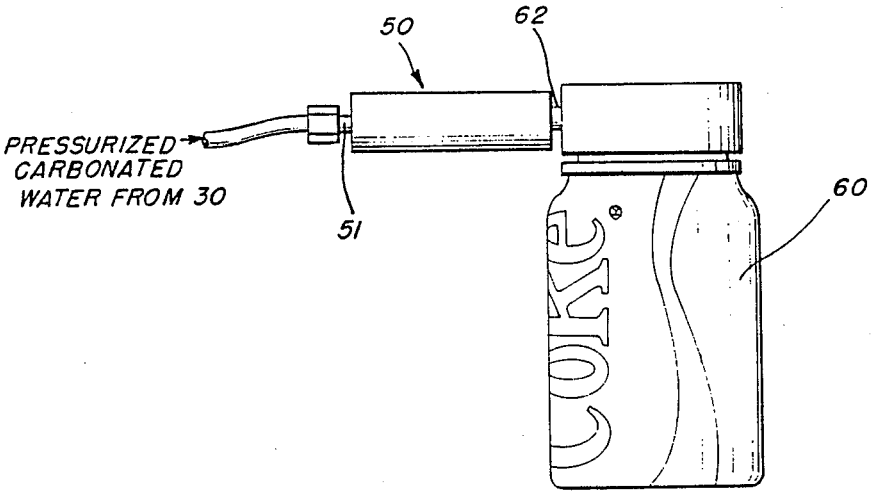
FIG. 3A is a diagramatic view of an alternative embodiment of the present invention for making a post-mix beverage from a single serving of flavor concentrate.

A system of this type is illustrated in FIGS. 3A and 3B. As illustrated therein the module 50 includes a tubular housing, an inlet port 50A at one end, and an outlet port 50B at the opposite end. A spring biased poppet PA is disposed within inlet port 50A and a spring biased poppet PB is disposed within outlet port 50B. These poppets are normally biased to seal on O-rings 54A and 54B, respectively. O-rings seals 52A and 52B are provided within the respective inlet and outlet ports 50A and 50B for engaging nozzles or couplings to be introduced from the carbonated water source supply through a nozzle 51 and a nozzle 62 extending from a beverage container 60. When the nozzles 51 and 62 are inserted into the inlet and outlet ports to sealingly engage the O-rings 52A and 52B, the ends of the respective nozzles open the poppets PA and PB to permit the flow of carbonated water through module 50 into the beverage container 60. Within module 50 is a pre-measured quantity of flavored concentrate sufficient to make enough carbonated beverage to fill the beverage container 60. Consequently, when carbonated water goes through module 50 it mixes with the flavor concentrate to form a post-mix beverage which flows into and fills the beverage container 60. Accordingly, the system illustrated in FIGS. 3A and 3B also facilitates the making of a plurality of servings of post-mix beverage from a common carbonated water source disposed within the Figal container 30 of FIG. 1.

It should be understood that the apparatus described herein may be modified as would occur to one of ordinary skill in the art without departing from the spirit and scope of the present invention.

What is claimed is:

1. A system for making and serving a carbonated post-mix beverage in the zero gravity conditions of outer space comprising:

(a) a flavor concentrate module including a tubular housing with threaded inlet and outlet ports and spring biased poppets in each of said ports for normally closing said ports;

(b) a pre-measured amount of flavor concentrate disposed within said module;

(c) a source of carbonated water coupled to the inlet port of said module and having means for opening the poppet in the threaded inlet port and engaging the threaded inlet port for introducing carbonated water into said module for mixing with flavor concentrate to form the carbonated post-mix beverage; and (d) a drinking container having tube means attached thereto, said tube means having a threaded fitting for engaging the threaded outlet port extending into the outlet port of said module to open the spring biased poppet therein and permit the carbonated post-mix beverage to flow into said drinking container.

2. A system for making and serving a carbonated post-mix beverage in the zero gravity conditions of outer space comprising:

(a) a flavor concentrate module including a housing with threaded inlet and outlet ports and spring biased poppets in each of said ports for normally closing said ports;

(b) a pre-measured amount of flavor concentrate disposed within said module;

(c) a source of carbonated water coupled to the inlet port of said module and having a threaded coupling opening the poppet in said inlet port for introducing carbonated water into said module for mixing with flavor concentrate to form the carbonated post-mix beverage; and (d) a drinking container having tube means attached thereto, said tube means having a threaded fitting for engaging the threaded outlet port extending into the outlet port of said module to open the spring biased poppet therein and permit the carbonated post-mix beverage to flow into said drinking container.

3. A system for making and serving a carbonated post-mix beverage in the zero gravity conditions of outer space comprising:

(a) a flavor concentrate module including a housing with inlet and outlet ports and spring biased poppets in each of said ports for normally closing said ports;

(b) a pre-measured amount of flavor concentrate disposed within said module;

(c) a source of carbonated water coupled to the inlet port of said module and having means for opening the poppet in said inlet port for introducing carbonated water into said module for mixing with flavor concentrate to form the carbonated post-mix beverage;

(d) a drinking container having tube means attached thereto, said tube means extending into the outlet port of said module to open the spring biased poppet therein and permit the carbonated post-mix beverage to flow into said drinking container; and (e) threaded end caps in engagement with said threaded inlet and outlet ports for confining the flavor concentrate in said tubular housing prior to coupling to said source of carbonated water and to said drinking container.

4. A system for making and serving a carbonated post-mix beverage in the zero gravity conditions of outer space comprising:

(a) a flavor concentrate module including a housing with inlet and outlet ports and spring biased poppets in each of said ports for normally closing said ports, said inlet and outlet ports and said poppets being disposed opposite to one another in a common bore, and the spring bias of the poppets being provided by a single bias spring disposed in the bore between the poppets;

(b) a pre-measured amount of flavor concentrate disposed within said module;

(c) a source of carbonated water coupled to the inlet port of said module and having means for opening the poppet in said inlet port for introducing carbonated water into said module for mixing with flavor concentrate to form the carbonated post-mix beverage; and (d) a drinking container having tube means attached thereto, said tube means extending into the outlet port of said module to open the spring biased poppet therein and permit the carbonated post-mix beverage to flow into said drinking container.

5. The system as defined by claim 4 wherein said source of carbonated water comprises a pressurized source.

* * * * *